United States Patent [19]

Kasprzyk et al.

[11] 4,390,859

[45] Jun. 28, 1983

[54] ELECTRIC THERMOSTAT WITH ADJUSTING KNOB

[75] Inventors: Donald J. Kasprzyk, Minn.; David A. Margenau, both of Maple Grove; Marvin D. Nelson, St. Louis Park, all of Mo.

[73] Assignee: Honeywell, Inc., Minneapolis, Minn.

[21] Appl. No.: 252,644

[22] Filed: Apr. 9, 1981

[51] Int. Cl.[3] ..... H01C 7/02; H01C 10/32

[52] U.S. Cl. ..... 338/25; 338/163; 338/164; 338/197

[58] Field of Search ..... 338/163, 25, 31, 160, 338/152, 162, 163, 197, 164, 184, 199, 334; 73/431, 362 AR; 403/375, 361, 405, 388, DIG. 3, DIG. 4

[56] References Cited

U.S. PATENT DOCUMENTS

| | | | |
|---|---|---|---|
| 2,909,749 | 10/1959 | Barden et al. | 338/163 |
| 3,124,775 | 3/1964 | Hamelberg | 338/163 |
| 3,431,781 | 3/1969 | Wiggin | 338/28 X |
| 3,485,102 | 12/1969 | Glick | 338/28 X |
| 3,832,669 | 8/1974 | Mueller et al. | 338/28 |

FOREIGN PATENT DOCUMENTS

| | | | |
|---|---|---|---|
| 586370 | 3/1947 | United Kingdom | 403/257 |

*Primary Examiner*—C. L. Albritton
*Attorney, Agent, or Firm*—Alfred N. Feldman

[57] ABSTRACT

An electric thermostat having a knob and potentiometer means with a simple adjusting means to couple the two together. A single clip means made of a resilient material allows for connecting the knob to the potentiometer and allows for repositioning the knob at will during calibration of the thermostat.

8 Claims, 3 Drawing Figures

ELECTRIC THERMOSTAT WITH ADJUSTING KNOB

BACKGROUND AND SUMMARY OF THE INVENTION

Electric thermostats typically are provided with an adjustment knob at some accessible point on the thermostat housing to set a value into the thermostat. During the manufacture of this type of thermostat it is quite common to assemble the unit including placing the adjusting knob in place. The thermostat may be subject to calibration at a later point in manufacture and this requires the repositioning of the adjusting knob with respect to the shaft upon which it is mounted.

Many different types of mounting means have been used, such as setscrews, pins, and clips. The present invention relates to a knob for an electric thermostat that relies on a novel clip means for its positioning. The clip means provides a number of different functions in addition to merely mounting the knob on a shaft, such as a potentiometer shaft, which adjusts a resistance value within the thermostat. The novel clip means of the present invention is provided in the form of a unitary member that is formed out of a resilient material, such as a spring metal. In additon to having projections which allow for expanding and opening a hole in the clip that mounts over the shaft to which it is to be joined, the clip is mounted in the knob in a resilient manner to absorb any shocks which occur when the knob reaches the end of its travel. The present simple clip and knob arrangement allows for repositioning of the knob at will during calibration of the thermostat.

DESCRIPTION OF THE PREFERRED EMBODIMENT

Figure 1:
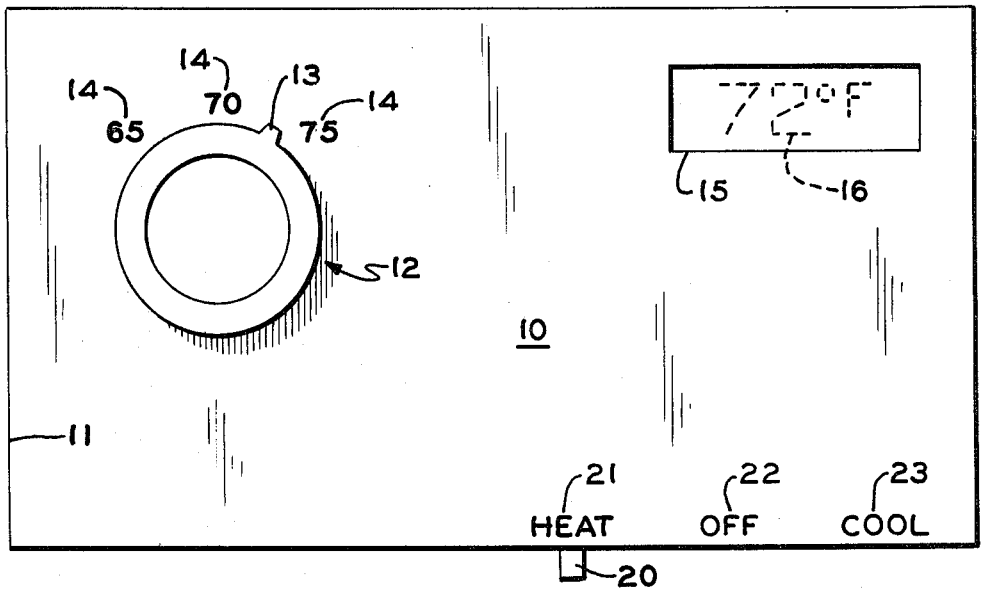
FIG. 1 is a front view of an electric thermostat.

In FIG. 1 there is disclosed at 10 an electric thermostat having a housing 11 that encloses and mounts the thermostat in a conventional manner. The thermostat 10 has a setting mechanism and a knob 12 with a pointer 13 that references the knob to the setpoint temperatures as indicated at 14. The thermostat 10 has an opening 15 through which a liquid crystal display provides a readout 16 of the actual temperature, which has been represented as 72 degrees Fahrenheit. The opening 15 could be used for other types of readouts in the form of conventional bimetal operated thermometers, or could be a readout of time if the electric thermostate was of a time programmable type of unit. The thermostat 10 further has a lever 20 that moves across the bottom of the thermostat 10 between a "heat" position 21, an "off" position 22, and a "cool" position 23.

To this point a conventional electric thermostat has been disclosed and the present invention is directed to the setting mechanism for the thermostat. The example of the thermostat structure disclosed in FIG. 1 is illustrative only.

Figure 2:
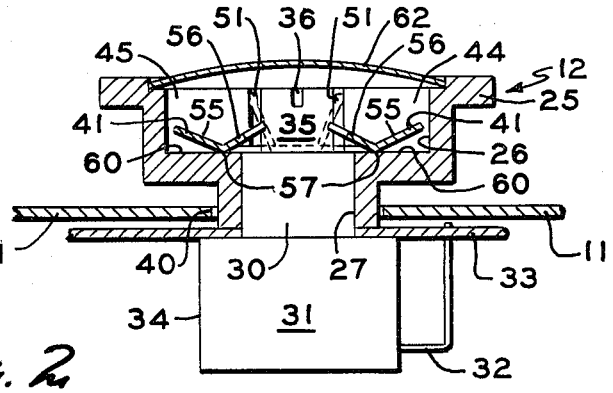
FIG. 2 is a cross section through the adjusting mechanism for the thermostat.

In FIG. 2 there is a cross section of the setting mechanism 12. The setting mechanism includes a potentiometer knob 25 that has a cavity or recess 26 and a hole 27 that is coaxial with a shaft 30 of a potentiometer means generally disclosed at 31. The potentiometer means 31 has conventional leads 32 projecting from it which are connected to a printed circuit board disclosed at 33. The printed circuit board provides the support for the potentiometer means 31 and for the electronic components that make up the electronic control circuitry for the thermostat 10. The potentiometer means 31 has the body portion 34 which is fixed in space within the thermostat by any convenient means including the lead wires 32 to the printed circuit board 33. In addition to the lower portion of the shaft 30, the shaft further extends upward at 35 where a screwdriver slot 36 exists for convenient adjustment of the potentiometer shaft with respect to the potentiometer body 34 so that the potentiometer means 31 can be adjusted before the knob 25 is put in place.

The knob 25 passes through an opening 40 in the housing 11 of the thermostat 10 and moves coaxially with the potentiometer shaft 36. It is obvious that if the potentiometer shaft 36 is to turn with the knob 25 that some mechanism must be provided to engage the shaft 36 to the knob 25. That mechanism is a clip means 41 that will be described in detail in connection with FIGS. 2 and 3.

Figure 3:
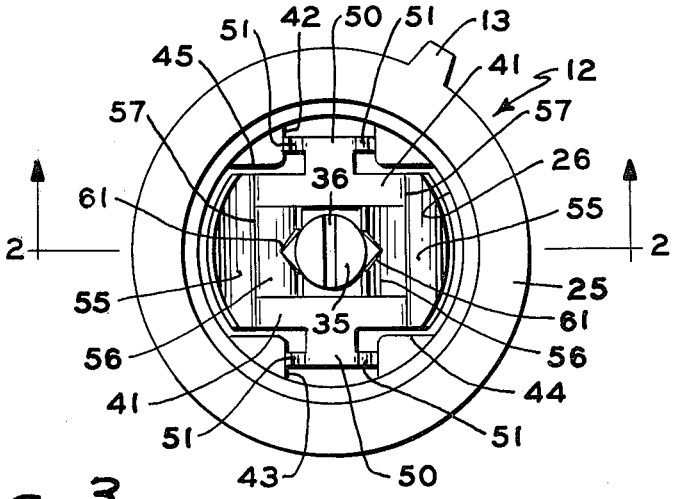
FIG. 3 is a section of FIG. 2 taken along lines 2—2.

The clip means 41 is recessed in the cavity 26 of the knob 25 as can best be seen in FIG. 3. The knob 25 has a cross-shaped recessed configuration to make up the cavity 26. Two portions of the cross-shaped section are identified at 42 and 43 and are basically at right angles to two further portions 44 and 45. The clip means 41 is recessed in the cavity 26 and is held in place by a pair of projections 50 that each have tabs 51 which frictionally engage the walls 42 and 43 of the cavity 26 to hold the clip means frictionally in place. The projection means 50 and the tabs 51 provide an additional function in that the tabs 51 are capable of flexing against the cavity walls 42 and 43 to act as a shock absorbing or take-up mechanism so that the clip means 41 is capable of rotating slightly with respect to the knob 25.

The clip means 41 has a pair of further projection means 55 that are substantially at right angles to the projection means 50. The projection means 55 are formed upward (as can be seen in FIG. 2) with respect to a plane parallel to the printed circuit board 33. The projection means 55 have extended portions 56 which are also extended upward with respect to the printed circuit board 33 as seen in FIG. 2, but at a different angle. The two projections 55 and 56 are joined along an edge 57 that acts as a pivot point against the bottom 60 of the cavity 26. As can be seen in FIG. 2, if the projections 55 are depressed, the projections 56 rock in an upward direction thereby opening their spacing around the potentiometer shaft 36. The opening in the clip means 41 (through which the potentiometer shaft 36 passes) has V-shaped cuts at 61 to provide a sharp bitting surface that engages the potentiometer shaft 36 to frictionally connect the clip means 41 to the potentiometer shaft 36. This in turn allows the clip means 41 to move with the potentiometer shaft 36, but since the clip means 41 is recessed in the cavity 26 it must move with the knob 25. The structure is completed by a domed cap 62 that is used to close the cavity 26 to prevent tampering with the adjustment once it has been made. The means of making the adjustment will now be described.

In the assembly of the electric thermostat disclosed in FIG. 10 the setting mechanism and knob 12 including the clip means 41 is initially positioned on the shaft 36 by pressing the knob 25 down over the shaft 36 while also engaging the clip means 41. The natural resilience of the clip means 41 allows it to frictionally engage the shaft 36 and effectively couples the knob 25 to the shaft 36. If during the adjustment procedure it becomes necessary to reposition the knob 25 with respect to the shaft 36. it is only necessary to apply a downward pressure (as viewed in FIG. 2) against the projection means 55 which in turn rocks the portions 56 up and away from the shaft 36 thereby releasing the shaft from engagement with the V-shaped grooves at 61. The knob 25 can then be repositioned with respect to the shaft 36 and the projection means 55 are released so that the V-shaped groove 61 engage the potentiometer shaft 36 once again at the desired location. This adjustment can be made as many times as necessary to obtain the proper calibration of the electric thermostat 10. Once the thermostat has been properly calibrated, the cover or dome 62 is set into the knob 25 to protect the adjustment against tampering.

The present invention is directed specifically to an electric thermostat and a means of connecting a potentiometer shaft to a knob for adjusting the thermostat in a manner that allows quick, convenient, adjustment of the relative positions of the knob and the shaft of the device. While many connection means are available, the present arrangement for attaching the knob to the potentiometer shaft is very quick, relatively inexpensive, and can be easily repositioned as necessary during the calibration of the unit. The projection means 50 provides not only a mounting means for the clip means 41, but act as a shock absorbing device in allowing some slight relative motion between the shaft 36 and the knob 25 when the potentiometer means 31 has reached a limit of movement. Many other variations are possible in the present invention including the material out of which the clip means 41 is manufactured. This unitary member typically would be manufactured from some type of spring steel, but could be fabricated of a single piece of any type of resilient material. Since many variations of the present invention are possible, the applicants wish to be limited in the scope of their invention solely by the scope of the appended claims.

The embodiments of the invention in which an exclusive property or right is claimed are defined as follows:

1. An electric thermostat, including: a housing to enclose and mount said thermostat; potentiometer means for setting an electrical value into said thermostat with said potentiometer means having a potentiometer body fixed in space within said thermostat; said potentiometer means further including a potentiometer shaft with said shaft being rotatable to adjust said potentiometer means to in turn set said thermostat; a knob having a hole with said hole being coaxial with said shaft to allow said knob to be placed over said shaft; said knob further including a cavity recessed into said knob with said shaft projecting into said cavity; clip means recessed in said cavity and formed of a single piece of resilient material; said clip means having an opening formed through said clip means with said opening normally being smaller than said shaft to allow a frictional engagement between said clip means and said shaft by said shaft passing through said opening in said clip means; and said clip means further having projection means being formed to allow said opening in said clip means to be biased against the natural resilience of said clip means to an enlarged size greater than said shaft to allow positioning said knob with respect to said shaft.

2. An electric thermostat as described in claim 1 wherein said clip means is formed of a resilient metal having spring-like properties to allow said opening in said clip means to be biased to enlarge said opening.

3. An electric thermostat as described in claim 1 wherein said clip means has second projection means with said second projection means resiliently mounting said clip means within said cavity; said second projection means allowing relative rotational motion between said knob and said clip means to absorb shocks between said potentiometer shaft and said potentiometer body when said knob is rotated.

4. An electric thermostat as described in claim 2 wherein said clip means has second projection means with said second projection means resiliently mounting said clip means within said cavity; said second projection means allowing relative rotational motion between said knob and said clip means to absorb shocks between said potentiometer shaft and said potentiometer body when said knob is rotated.

5. An electric thermostat is described in claim 4 wherein said opening in said clip means is V-shaped to increase the frictional engagement between said clip means and said shaft.

6. An electric thermostat as described in claim 2 wherein said opening in said clip means is V-shaped to increase the frictional engagement between said clip means and said shaft.

7. An electric thermostat as described in claim 3 wherein said second projection means includes tab means to frictionally engage a pair of walls of said cavity to hold said clip means in place in said cavity.

8. An electric thermostat as described in claim 4 wherein said second projection means includes tab means to frictionally engage a pair of walls of said cavity to hold said clip means in place in said cavity.

* * * * *